United States Patent [19]

Ferencz et al.

[11] Patent Number: 4,830,741

[45] Date of Patent: May 16, 1989

[54] METHOD FOR EFFICIENT SEPARATION OF COAL FROM COAL SPOIL IN TWO STAGES OF HYDROCYCLONIC SEPARATION

[75] Inventors: Jozsef Ferencz, Budapest; Istvan Felmeri; Rezso Stum, both of Tatabanya, all of Hungary

[73] Assignee: Haldex Vallalat, Tatabanyai, Hungary

[21] Appl. No.: 175,423

[22] Filed: Mar. 30, 1988

[30] Foreign Application Priority Data

Oct. 6, 1987 [HU] Hungary ..... 4472/87

[51] Int. Cl.[4] ..... B03B 5/30

[52] U.S. Cl. ..... 209/173; 209/211; 209/17

[58] Field of Search ..... 209/13, 17, 172, 172.5, 209/173, 211

[56] References Cited

U.S. PATENT DOCUMENTS

| | | | |
|---|---|---|---|
| 2,497,790 | 2/1950 | Pauvrasseau | 209/173 |
| 2,693,878 | 11/1954 | Driessen et al. | 209/172.5 |
| 2,754,963 | 7/1956 | Hoensbroek | 209/12 |
| 3,031,074 | 4/1962 | Osawa | 209/172.5 X |
| 3,746,265 | 7/1973 | Dancy | 241/20 |
| 3,869,559 | 3/1975 | Clark | 209/173 X |
| 4,028,228 | 6/1977 | Ferris et al. | 209/39 |
| 4,169,786 | 10/1979 | Horsfall | 209/172.5 X |
| 4,203,831 | 5/1980 | Parnaby | 209/13 |
| 4,222,529 | 9/1980 | Long | 241/77 |
| 4,364,822 | 12/1982 | Rich, Jr. | 209/3 |
| 4,571,296 | 2/1986 | Lott | 209/211 |
| 4,584,094 | 4/1986 | Gadsby | 209/17 |

FOREIGN PATENT DOCUMENTS

| | | | |
|---|---|---|---|
| 533605 | 3/1980 | Australia . | |
| 662794 | 12/1951 | United Kingdom | 209/173 |
| 777561 | 6/1957 | United Kingdom | 209/17 |

OTHER PUBLICATIONS

Foreman et al., "Current Status of Hydrocyclone Technology", *Mining Congress Journal,* Dec. 1972, pp. 50–56.

*Primary Examiner*—Joseph J. Rolla

*Attorney, Agent, or Firm*—Pollock, Vande Sande & Priddy

[57] ABSTRACT

A system operating in accordance with the method of the invention can be compared to a single stage enrichment by noting that in the single stage system, 100% (or all) of the underflow output of the first stage would go into refuse, i.e. whatever desirable product is contained in the underflow of the first stage would be lost. In contrast to this system, in accordance with invention, a middling fraction is directed back into stage 2 (along with spoil) which results in self-enriching the material undergoing separation in the second stage. Eventually the enriched coal will be contained in that portion of the overflow output of the second stage which is directed back to the first stage, and for that reason the losses going into the spoil will be reduced in comparison to the enrichment loss in the first stage.

10 Claims, 2 Drawing Sheets

FIG.2a
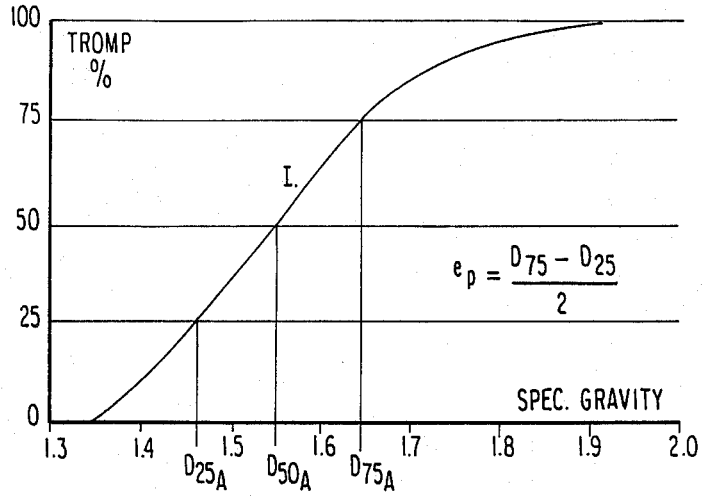
FIG.2b
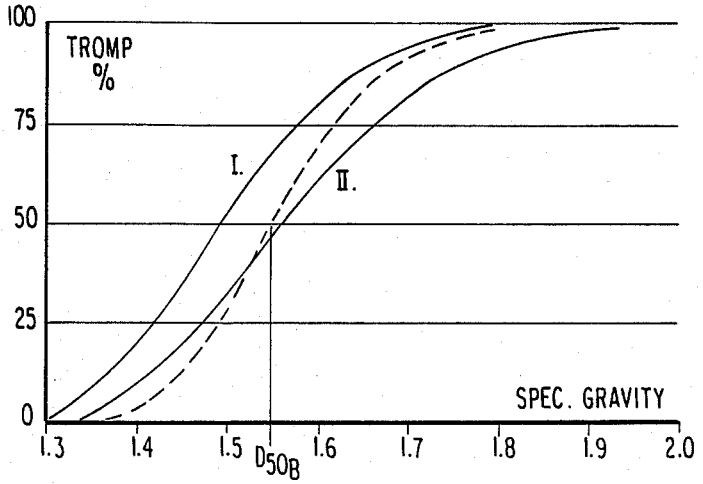
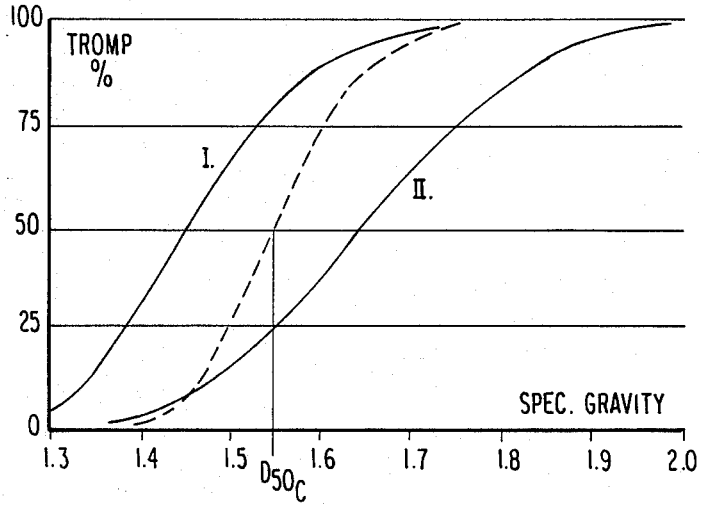
$D_{50A} = D_{50B} = D_{50C}$
$e_{p_A} > e_{p_B} > e_{p_C}$
$Rec_B < Rec_C$
FIG.2c

METHOD FOR EFFICIENT SEPARATION OF COAL FROM COAL SPOIL IN TWO STAGES OF HYDROCYCLONIC SEPARATION

DESCRIPTION

Technical Field

The invention relates to the separation or enrichment of a mixture of coal and coal spoil.

Background Art

The use of hydrocyclones for the separation of coal and spoil, or enrichment of coal from the raw material comprising a mixture of coal and spoil is described by Foreman, "Current Status of Hydrocyclone Technology" appearing in the *Mining Congress Journal* for Dec. 1972 at pages 50 et seq and in the Australian Pat. No. 533,605.

Hydrocyclonic separation first mixes the raw material to be separated with a suspension medium typically consisting of fine granules and a liquid such as water. In the hydrocyclone the mixture is sorted according to specific gravity, i.e. the lighter coal separates from the heavier spoil. Long, in U.S. Pat. No. 4,222,529, describes a multistage cyclone separator apparatus and also refers to various other, prior art multistage cyclonic separation devices. Other pertinent disclosures are Gadsby, U.S. Pat. No. 4,584,094, Ferris U.S. Pat. No. 4,028,228 and Pauvrasseau, U.S. Pat. No. 2,497,790. Separation effected by this difference in specific gravity is, however, not perfect. For any such hydrocyclonic separation stage, there is a so called separation specific gravity; this is the specific gravity wherein 50% of the material leaves the separation stage via an overflow outlet corresponding to the lighter specific gravity material and 50% of the same specific gravity material leaves the cyclonic separator through an underflow outlet, corresponding to the heavier specific gravity material. For material with specific gravity less than the separation specific gravity, more than 50% of the material leaves through the overflow and less than 50% leaves through the underflow, and vice versa. The operator of a hydrocyclonic stage thus has two contending considerations. In order to decrease the quantity of refuse material output through the overflow outlet, the separation specific gravity should be reduced; this action will tend to make the output at the overflow outlet include less and less of the undesirable spoil. The problem with this approach is the very same action increases the percentage of the desired lower specific gravity material which passes out through the underflow outlet, along with the spoil. In an attempt to overcome this problem, efforts have been made to artificially increase the separation specific gravity by increasing the density of the mixture in the hydrocyclone. Unfortunately, increases in the specific gravity in the hydrocyclonic separation stage also increases the viscosity of the material and hence the time it takes for the separation to occur. It is this difficulty which has led to the thought of using multiple stages of hydrocyclonic separation.

FIG. 11 of the Foreman publication is perhaps the most relevant of the prior art since he describes two stages of hydrocyclonic separation, where it is the underflow from the first stage which is used, in part, as the input to the second stage, and it is the overflow from the second stage which is fed back to the intake at the first stage; the underflow from the second stage is discarded as refuse.

It is an object of the present invention to improve prior art, hydrocyclonic separation methods and allow the separation to be optimized depending on capacity of the equipment, the raw material input, etc.

As will be described below, in accordance with one embodiment of the invention the raw material is mixed with a suitable suspension agent and input at the intake of a first stage of hydrocyclonic separation. The overflow from the first stage of hydrocyclonic separation is output as enriched coal; the underflow from the first stage of hydrocyclonic separation is input to a second stage of hydrocyclonic separation. The underflow output of the second stage is output as refuse. The rate of the overflow output of the second stage of hydrocyclonic separation is first measured (in terms of either mass or volume per unit) and then separated into two predetermined fractions. A first predetermined fraction is recirculated to the intake of the first stage of hydrocyclonic separation, and remainder is recirculated back to the input of the second stage of hydrocyclonic separation. The result of the action of the second stage of hydrocyclonic separation is to enrich the material produced on the spoil side of the first stage and the overflow output of the second stage of hydrocyclonic separation is a material of middling character. In accordance with the method of the invention, the parameters of the first stage of hydrocyclonic separation, e.g. specifically the specific gravity of the medium, is set independently of the proportion of desirable coal that may be discharged at the underflow output of the first stage of hydrocyclonic separation. More particularly, the specific gravity or density of the first stage can be selected so as to approach most closely the most important parameter of the desired end product, e.g. the coal's ash content. In accordance with the invention, the separation specific gravity in the second stage of hydrocyclonic separation is established to be higher than that of the first stage. The specific gravity of the second stage can be controlled based on a measurement of the quantity (volume or weight per unit time) of the middlings recirculated from the overflow output of the second stage.

If the foregoing procedure is followed, the resultant separation curve of the two different stages will afford the sharpest possible separation available in a two-stage process, i.e. an optimum separation.

A system operating in accordance with the method of the invention can be compared to a single stage enrichment by noting that in the single stage system, 100% (or all) of the underflow output of the first stage would go into refuse, i.e. whatever desirable product is contained in the underflow of the first stage would be lost. In contrast to this system, in accordance with the invention, a middling fraction is directed back into stage 2 (along with spoil) which results in self enriching the material undergoing separation in the second stage. Eventually the enriched coal will be contained in that portion of the overflow output of the second stage which is directed back to the first stage, and for that reason the losses going into the spoil will be reduced in comparison to the enrichment loss in the first stage.

By using the recirculation, i.e. sending middlings back into the first stage of hydrocyclonic separation, we enrich the fraction of the raw material in the first stage of hydrocyclonic separation. Granules having a specific gravity close to the selected specific gravity lowers the proportion of the medium in the selection region of the hydrocyclone and thus increases the specific gravity of the barrier layer which is impenetrable to the desired product. As a result, by recirculating the middlings, an increase in the selected specific gravity follows, i.e. which is the desired result. This process can be intentionally boosted if we produce recirculated material with a higher selected specific gravity in the second stage of hydrocyclonic separation.

A similar phenomenon takes place in the second stage as a result of accumulating middling material recirculated there.

BRIEF DESCRIPTION OF THE DRAWINGS

The present invention will now be described in the following portions of this specification when taken in conjunction with the attached drawings in which like reference characters identify identical apparatus and in which:

FIGS. 2A–2C are separation specific gravity curves representing operation, in the case of FIG. 2A of a typical single stage hydrocyclone separation, FIG. 2B shows separation curves I and II for first and second stages of hydrocyclonic separation and a dashed curve for the combined operation wherein the two stage system is not optimized; and FIG. 2C shows three separation specific gravity curves, one I for the first stage of hydrocyclonic separation, another II for a second stage of hydrocyclonic separation and a dashed curve showing the resultant, in the case when parameters of the two hydrocyclonic separators have been optimized in accordance with the present invention.

DETAILED DESCRIPTION OF PREFERRED EMBODIMENTS

Figure 1A:
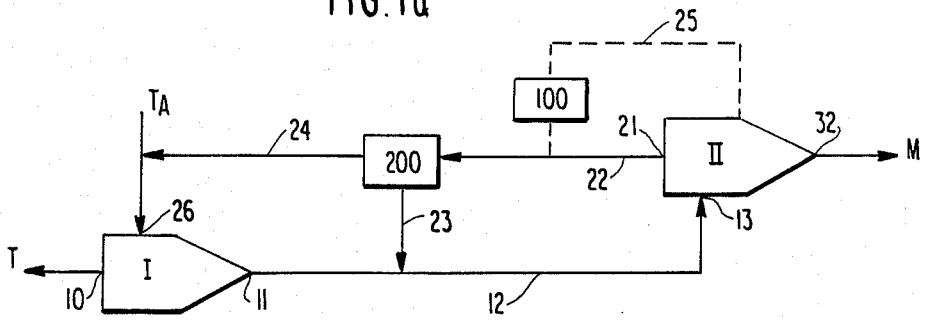
FIG. 1A is a schematic diagram of the method in accordance with a first embodiment of the invention.

FIG. 1A is a schematic diagram of a method in accordance with a first embodiment of the invention. In FIG. 1A, I represents a first stage of hydrocyclonic separation which has an overflow output 10 at which the lower specific gravity material is output, and an underflow output 11 at which higher specific gravity material is output. The higher specific gravity material output at the underflow output 11 travels the path 12 to the intake 13 of the second stage of hydrocyclonic separation II. The second stage II has a first, overflow output 21 at which lower specific gravity material tends to be output. The second stage of hydrocyclonic separation II has a second, underflow output 32 at which material of higher specific gravity tends to be output. The material output of the underflow output 32 of the second stage II is considered spoil M and is discarded.

The overflow output 21 from stage II travels a path 22. A measuring station 100 is located along the path 22 for measuring a parameter related to the quantity of material travelling along the path 22. The measurement effected by the measurement station 100 can be either a mass rate measurement (weight per unit time) or a volume rate measurement (volume per unit time). After the material on the path 22 passes the measurement stage 100, it enters a divider 200. Material entering the divider 200 along the path 22 is divided into a first portion, exiting along a path 24 and a second portion, exiting along a path 23. The material exiting along the path 24 travels to the intake 26 of the first stage of hydrocyclonic separation I. Material exiting along the path 23 is merged with material travelling along the path 12 to enter the intake 13 of the second stage of hydrocyclonic separation II. The measurement effected at the stage 100 is compared with a predetermined, desired quantity (whether mass per unit time or volume per unit time) and variations in the measured parameter from the desired parameter are used, via the path represented at 25, to control the specific gravity of the mixture in the second stage of hydrocyclonic separation II.

In a steady state condition, the method depicted in FIG. 1A operates as follows:

Raw material, comprising a mixture of a desired coal product, and spoil $T_a$, is input at the intake 26 of a first stage of hydrocyclonic separation I. The material input at the intake 26 is divided into two portions, a lower specific weight portion which exits via the overflow 10. This is collected as the desired coal product T. The heavier portion exits at the underflow 11 and is input to the intake 13 of the second stage II. The second stage also effects a separation of the material contained therein into a lighter fraction, exiting via the overflow outlet 21, and a higher specific weight fraction exiting at the underflow 32. The latter is considered spoil M and is discarded.

The lower specific weight material output at the second stage II is considered middlings. The middlings travel a path 22 to the divider 200 wherein a first portion of the middlings, travelling over the path 24 is recirculated back to the first stage of hydrocyclonic separation I. The remaining portion of the middlings travels the path 23, where it merges with the path 12 and is reintroduced at the intake 13 of the second stage of hydrocyclonic separation. The proportions of the middlings travelling the path 22 which are divided into the first portion, travelling over the path 24, and the second portion, travelling over the path 23, are predetermined with regard to the rate at which raw material is being added to the first stage, the capacities of the first and second stages, etc. To understand the benefits of the two stages of hydrocyclonic separation, with the parameters adjusted as aforesaid, reference is now made to FIG. 2A.

FIG. 2A represents, by the curve I, the operation of a single stage of hydrocyclonic separation. The ordinate of FIG. 2A is divided on a percentage scale, and the abscissa represents specific gravity. The curve indicates, for example for material of specific gravity $D_{25A}$ (approximately 1.46 grams per cubic centimeter), that 25% of this material will be discharged through the hydrocyclone's underflow, and the remaining (75%) will be discharged through the hydrocyclone's overflow. As another example, material of specific gravity referenced as $D_{75A}$, 75% of this material will be discharged via the hydrocyclone's underflow and the remaining (25%) will be discharged via the hydrocyclone's overflow. One aspect of optimizing a single stage of hydrocyclonic separation is that whereas the actual operation curve I has a non-zero but finite slope, desirably the slope would be infinite, i.e. the curve I desirably should be a vertical line, so that 100% of the material with a specific gravity less than the intercept between the curve and the abscissa will be discharged via the overflow outlet and 100% of the material with specific gravity greater than the intersection of the curve and the abscissa will be discharged through the underflow. While for physical reasons it is not possible to obtain a separation curve which is vertical (infinite slope) it should be apparent that increasing the slope of the separation curve is desirable.

While it is not possible to obtain a vertical separation curve, there are advantages to operating the first stage of hydrocyclonic separation (which provides the desired coal product output directly) at a relatively lower separation specific gravity. Operating the first stage at the lower separation specific gravity will tend to reduce the quantity of high specific gravity (undesirable) material which is introduced into the final coal product. Likewise, it is also of advantage to operate the second stage of hydrocyclonic separation at a higher separation specific gravity. Operating the second stage at a higher separation specific gravity will tend to reduce the amount of desired coal which exists the underflow outlet and is thereby discarded. This operation is represented in FIG. 2B, wherein the curve I represents operation of the first stage of hydrocyclonic separation and the curve II indicates operation of the second stage II. The dotted curve represents the combined operation of a two stage system. As thus far explained, the curves I and II have essentially the same slopes, whereas the dotted curve (the resultant of the operation of the two stages) has a steeper slope than either of the curves I or II (or either FIG. 2A or FIG. 2B). Thus, it should be apparent that even operating in accordance with FIG. 2B, the method schematically illustrated in FIG. 1A provides an advantage over single stage systems.

However, we have found that operation of a two stage system such as is depicted in FIG. 1 can be optimized, i.e. its performance can be improved over that depicted in FIG. 2*b*. The optimized performance is shown in FIG. 2*c*. FIG. 2*c* illustrates at least three differences over FIG. 2*b*. In the first case, the separation specific gravity of the first stage has been further reduced and a second difference is that the separation specific gravity of the second stage has been increased. The resultant (the dashed curve) shows a significantly steeper slope than either the resultant (dashed) curve of FIG. 2*b* or the curve of FIG. 2*a*. The optimum condition of FIG. 2*c* is achieved by increasing the specific gravity of the material in the second stage of hydrocyclonic separation and likewise increasing the amount (whether mass per unit time or volume per unit time) of the recirculated middlings until the capacity of the first stage of hydrocyclonic separation is reached (for a given rate of introduction of raw material and particle size and distribution in the raw material).

The two stage hydrocyclonic system described above, characterized by having optimal density regulation, stabilized recirculation adjustment and a selection density increase brought about by recirculation, is especially suitable for running hydrocyclones with obligatory soil-suspension and coal suspension media and with higher fine granule concentrations due to low middle specific gravities and with higher viscosities. The method makes it possible to obtain higher separation specific gravity values or more favorable selection parameters assuming the same values. A system operator can judge, from successive experimentation (according to the curves such as shown in FIG. 2*c*, and on the basis of parameters $D_{50}$, $e_p$ and Rec as shown in the table of FIG. 2*c*, for example). Based on a given mixture of coal/spoil, and a given distribution of particle size of the various coal and spoil particles, the operator can select for example the separation specific gravity of the first stage, the separation specific gravity of the second stage, the desired parameter to be measured (at the station 100 and either weight or volume rate) and the dividing proportions in the divider 200.

Figure 1B:
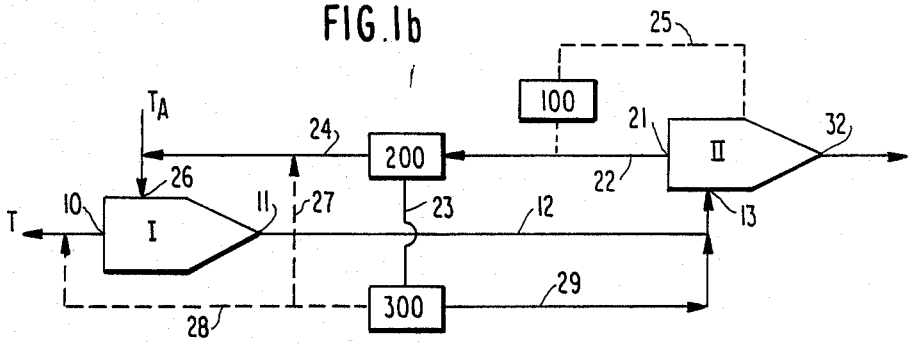
FIG. 1B is a schematic diagram of a method practiced in accordance with a second embodiment of the invention.

FIG. 1*b* shows a modification of the flow diagram of FIG. 1*a*. Similar reference characters in FIG. 1*b* refer to identical apparatus. FIG. 1*b* differs from FIG. 1*a* in that the predetermined fraction of the overflow output of the second stage which is directed over the path 23 does not merge with the path 12 (carrying underflow output from the first stage I). Rather, the path 23 is fed to a selective crusher 300, or any other device which can work the material travelling over the path 23 and graded into two fractions (typically based on specific gravity). Those skilled in the art are familiar with selective crushers 300 or equivalent devices, and therefore such devices need not be described herein in detail. However, the higher specific gravity fraction of the output from the selective crusher 300 is fed over a path 29 where it does merge with the material travelling over the path 12 to the intake 13 of the second stage II. The lighter fraction of the output of the selective crusher 300 can follow either a path 27 or the path 28. It should be apparent of course that if the lighter fraction output of the selective crusher 300 follow the path 27, it merges with material flowing over the path 24 and is thus fed to the input 26 of the first stage I. On the other hand, if the lighter fraction output of the selective crusher 300 follows a path 28, it merges with the end product output of the overflow output 10 of the first stage I.

Figure 1C:
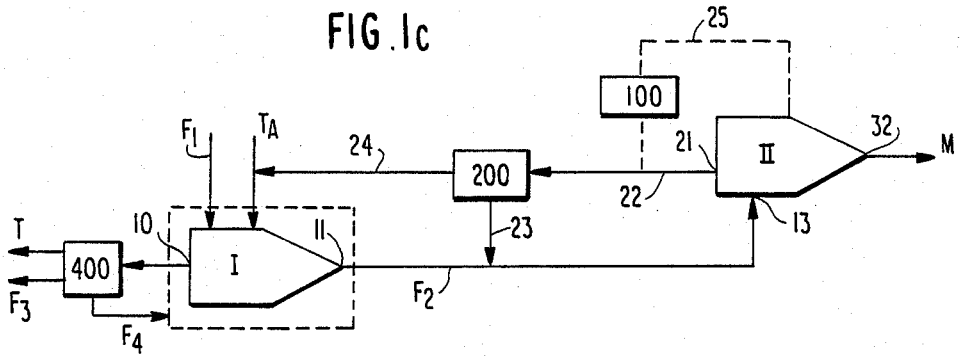
FIG. 1C is a schematic diagram of a method in accordance with a further embodiment of the invention.

FIG. 1*c* shows a further modification which can be used either with the embodiment shown in FIG. 1*b* or the embodiment shown in FIG. 1*a*. The variation illustrated in FIG. 1*c* relates to the first stage I. FIG. 1*c* differs from FIGS. 1*a* and 1*b* in showing explicitly that in addition to the raw material $T_A$ which is introduced into the first stage, we also introduce the suspension medium $F_1$ (introduction and suspension medium $F_1$ is not explicitly shown in FIGS. 1*a* and 1*b* but it, of course, is necessary). FIG. 1*c* shows that the desired coal output at the overflow output 10 of the first stage I is input to a separating element 400 which may for example be a vibrating screen for desludging coal and a following device such as a settling tank or a hydrocyclone battery to sort from the sludge the lighter (and therefore more viscous) part of the medium from the heavier part (which has a more favorable viscosity). The separating element 400 has a first output labelled T over which passes the desired coal product. The underflow from the vibrating screen is, as shown in FIG. 1*c*, divided into two parts by the settling tank or the like. The lighter component of the suspension medium $F_3$ (which is necessarily therefore more viscous) is eliminated. However, the more favorable fraction $F_4$ of the suspension medium is returned back to the system so as to improve the viscosity characteristics of the medium in the first stage I. The material improvement to stage I is also reflected in an improvement in stage II since stage I separates the material with the heavier underflow directed to stage II. Thus, that underflow $F_2$ is directed to stage II to thereby also improve the material there.

The approach discussed carries out the separation, for all practical purposes, according to the specific gravity of a heavy suspension, a process in which the viscosity attributed to the given specific gravity of a medium and other properties, including the upper boundary of a still utilizable density is important. This assertion does not require proof. For this reason we envisage a developmental mode which is more sharply separative, thus giving more coal production at a given quality.

We want to stress, that the size of the sieve that sorts between the fine granular fraction forming the medium and the enriching material was so determined, since the finer material under measurement, on the one hand, cannot be enriched in a satisfactory fashion during the process, and on the other hand, in consequence of their granular composition they can be used to form the water suspension medium for the process.

In our invention we utilized that observation, according to which the hydrocyclones used to enrich the 0–50 (max.) mm grain-size raw material employed in the above-detailed description in reality have a defined selection capability (according to the specific gravity and grain size) at their disposal, i.e. the suspension is practically in the 0–0.5 mm size area. We learned that the granular composition found in the spoil portion emerging on the conical side was coarser than the mixture measured on the opposite side. We found the suspension-forming properties of the fine-grained material on the spoil side more favorable, and the viscosity measured primarily in the same substance density was lower.

We intentionally used this factor in designing the two-stage system described here: we worked out such a movement of a suspended medium, in which the hydrocyclonic enriching stages I and II concentrate a suspension fraction of a favorable quality (which they produced themselves) into stage II receivers where, besides a higher substance density, relatively more favorable selective conditions are created. We reach this goal according to FIG. 1*c*. The suspension medium $F_1$ receives fresh replacement from the raw material injected for processing. In the course of the above treatment the fresh suspension forming granules of mixed composition are segregated in the method described; that is, the portion with more favorable qualities advances to stage II and is concentrated there, while the portion of finer composition and therefore more viscous $F_3$—which arose decidedly out of cyclonic stage I on the coal-product side T—can can and must be gotten rid of. We intentionally refine the suspension surplus that is carried away by converting a tapping place from 400 to a decanting vessel, out of which the surplus of the finest composition $F_4$ can flow, while the viscosity characteristics of the medium regenerated by making use of the part $F_4$ returning into the system are improved.

Comparing the present invention with the prior art single stage systems, consider separation of a so-called self-suspended coal slury medium according to the specific gravity of the raw material with a high coal content. Because of a rise in the viscosity, the actual concentration attain results in a substance density of only 1.17 grams per cubic centimeter. A HALDEX type hydrocyclonic system operated with such a medium produced a separation specific gravity of 1.5 grams per cubic centimeter with an imperfection value of 0.16. Converting such a system to a duplex system such as shown in any of FIGS. 1*a*–1*c*, together with unchanged raw material conditions, produced a separation specific gravity of 1.5 grams per cubic centimeter with an imperfection value of 0.13 which can be improved to a 0.12 level according to the principles described herein by optimizing as well as by developing a segregating suspension medium. In the course of optimizing, we selected the predetermined fraction travelling over the path 24 as 20% of the input to the dividing stage 200.

While several different specific embodiments of the invention have been described in specific detail herein, these examples are non-limiting and the scope of the invention is to be judged by the claims which are attached hereto.

We claim:

1. A method of enriching raw material comprising a mixture of coal and coal spoil to produce an enriched coal product using hydrocyclonic separation with a suspension medium containing coal, coal spoil and a liquid comprising the steps of:

(a) providing first and second stages of hydrocyclonic separation, each of said stages including an intake and first and second outputs, (b) supplying to said intake of said first stage of hydrocyclonic separation said raw material comprising a mixture of coal and coal spoil to be enriched, (c) extracting at a first output of said first stage of hydrocyclonic separation an enriched coal product and extracting at a second output of said first stage of hydrocyclonic separation a mixture of coal and coal spoil, (d) providing said mixture of coal and coal spoil from said second output of said first stage of hydrocyclonic separation to said intake of said second stage of hydrocyclonic separation, (e) extracting at a first output of said second stage of hydrocyclonic separation a middling type material and extracting at a second output of said second stage of hydrocyclonic separation a refuse type material, (f) dividing said middling type material from said second stage of hydrocyclonic separation into a first part and a second part, (g) directing said first part of said middling material to an intake of said first stage of hydrocyclonic separation and directing said second part to an intake of said second stage of said hydrocyclonic separation.

2. A method as recited in claim 1 further comprising:

(h) measuring a quantity related to said middling type material extracted at the first output of said second stage of hydrocyclonic separation and controlling separation density of said second stage of hydrocyclonic separation in dependence on variations of said measured quantity.

3. A method as recited in claim 2 wherein said measured quantity is a weight rate measurement such as a weight of extracted middling material per unit time.

4. A method as recited in claim 2 wherein said measured quantity is a volume rate measurement such as volume of extracted middling material per unit time.

5. A method as recited in any one of claims 2, 3 or 4 wherein the step (h) comprises reducing the separation density of the second stage in response to a rise in the measured quantity and increasing the separation density of the second stage in response to a fall in said measured quantity.

6. A method as recited in claim 1 or claim 2 further comprising:

(i) mechanically working the second part of the middling type material and separating from the worked second part a low density third part, directing said low density third part to said first stage of hydrocyclonic separation.

7. A method as recited in claim 6 wherein said low density third part of the middling type material is merged with the enriched coal product at the first output of the first stage of hydrocyclonic separation.

8. A method as recited in claim 6 wherein said low density third part of the middling type material is merged with the intake to the first stage of hydrocyclonic separation.

9. A method as recited in claim 1 comprising the further steps of:

(h) separating material produced at said first output of said first stage of hydrocyclonic separation into a coal fraction and a suspension fraction, (i) dividing said suspension fraction into a lighter and a heavier suspension fraction, discarding said lighter suspension fraction and returning said heavier suspension fraction back for reuse in said hydrocyclonic separation.

10. A method as recited in claim 9 wherein said heavier suspension fraction returned to said first stage is, in part, directed from said second output of said first stage, to said second stage of hydrocyclonic separation.

* * * * *